US005845864A

United States Patent [19]

Hermanns et al.

[11] Patent Number: 5,845,864

[45] Date of Patent: Dec. 8, 1998

[54] TRANSPORT SYSTEM FOR A TEXTILE MACHINE

[75] Inventors: Ferdinand-Josef Hermanns; Helmut Kohlen, both of Erkelenz; Reinhard Groneberg, Mönchengladbach, all of Germany

[73] Assignee: W. Schlafhorst AG & Co., Germany

[21] Appl. No.: 927,712

[22] Filed: Sep. 10, 1997

[30] Foreign Application Priority Data

Sep. 10, 1996 [DE] Germany ..... 196 36 661.5

[51] Int. Cl.[6] ..... B65H 67/02; B65H 54/00; B65G 47/46

[52] U.S. Cl. ..... 242/474.1; 57/281; 198/350; 242/475.8

[58] Field of Search ..... 242/474, 474.1, 242/474.2, 470, 473.4, 475.7, 475.8; 57/281; 198/350

[56] References Cited

U.S. PATENT DOCUMENTS

| | | | |
|---|---|---|---|
| 4,182,452 | 1/1980 | Hulscher . | |
| 4,681,231 | 7/1987 | Ueda et al. | 242/470 X |
| 4,854,439 | 8/1989 | Ueda . | |
| 4,913,373 | 4/1990 | Ueda | 242/474 X |
| 5,058,816 | 10/1991 | Schreiber | 242/475.8 |
| 5,190,136 | 3/1993 | Grecksch et al. . | |
| 5,289,983 | 3/1994 | Ueda et al. | 57/281 |
| 5,348,221 | 9/1994 | Grecksch et al. | 242/470 |
| 5,359,160 | 10/1994 | Wirtz | 198/350 |
| 5,497,952 | 3/1996 | Iding | 242/475.8 |

FOREIGN PATENT DOCUMENTS

| | | |
|---|---|---|
| 0 593 808 A1 | 4/1994 | European Pat. Off. . |
| 2 131 280 | 1/1972 | Germany . |
| 21 35 330 B2 | 2/1976 | Germany . |
| 36 27 586 A1 | 3/1987 | Germany . |
| 37 42 112 A1 | 6/1988 | Germany . |
| 36 03 002 C2 | 3/1990 | Germany . |
| 38 41 812 A1 | 7/1990 | Germany . |
| 40 05 548 A1 | 8/1991 | Germany . |
| 40 41 713 A1 | 6/1992 | Germany . |

OTHER PUBLICATIONS

Hans Friedrich, "Zielsteuerverfahren für Stückgut–Förderanlagen", pp. 1–7, 1971.

*Primary Examiner*—Michael Mansen
*Attorney, Agent, or Firm*—Kennedy Covington Lobdell & Hickman, LLP

[57] ABSTRACT

A textile package transport system utilizing transport plates for transporting spinning cops, particularly within a textile machine which produces cheeses. Each transport plate has an information storage medium in the form of a magnet of ferromagnetic material having a high retentivity encodable by selective polarization thereof. Electrically chargeable encoding coils are arranged in the transport system to selectively apply a defined polarity to the magnets. The encoding coils are actuated by way of sensor signals generated as a function of a processing status of the spinning cop and Hall sensors are utilized for detecting the respective polarity of the magnets. Controllable electric switches are disposed in the transport system for controlling the conveyance of the transport plates within the system.

14 Claims, 2 Drawing Sheets

TRANSPORT SYSTEM FOR A TEXTILE MACHINE

FIELD OF THE INVENTION

The present invention relates to a transport system for a textile machine with circulating transport carriers for transporting spinning cops, wherein the transport plates have information carriers, which can be acted upon electromagnetically.

BACKGROUND OF THE INVENTION

It is known in connection with the joining of automatic textile machines, such as when coupling ring spinning machines with automatic cheese winders with a transport system for conveyance of textile packages between the machines by means of transport carriers, to equip the transport carriers circulating inside the composite device with individual identification markings.

By way of example, German Patent Publication DE 36 03 002 C describes such an installation utilizing transport plates having identification markings in the form of a bar code or a magnetic strip, whereby it is possible, for example, to recognize the production site of the spinning cops by means of the identification markings.

However, such markings are very sensitive to the airborne fibers and debris, which are unavoidable in spinning or winding operations. It has therefore already been proposed to equip the transport plates with electronic information carriers which are impervious to debris.

A transport system is also known from German Patent Publication DE 40 41 713 A1, wherein the respective transport plates have a codable, readable and erasable electronic information carrier, which can be coupled in a contactless manner with a stationary read, erase and coding device. A transmitter/receiver antenna for the information carrier is arranged in the area of the center axis of the transport plate in such a way that it has the same effective transmission distance to the transmitter/receiver antenna of the stationary read, erase and coding device regardless of the angular rotational position of the transport plate. The data transmission can be performed in a contactless manner by an inductive, capacitive or electromagnetic means.

European Patent Publication EP 0 593 808 A1 describes a device in which a so-called transponder has been installed in the transport plates of the transport system. These electronic information carriers are passive per se and are activated electromagnetically via sensor devices to radiate an individual, unchangeable identification signal which is respectively assigned to a defined textile bobbin and is read into a memory and evaluation unit. The memory and evaluation unit has a plurality of memory locations each of which is respectively assigned to a defined identification signal associated with an individual electronic information carrier. The production data, the quality data or deviations from a set value of the respective textile bobbins are stored in the memory sites. Sensor devices for detecting the individual identification signals of the electronic information carriers are disposed at the forks of the bobbin transport devices. A batch-specific association of the textile bobbins can be provided by a comparison of the data in the memory sites of the memory and evaluation unit.

Although transport systems having the above described electronic information carriers operate quite dependably and permit the transmission of a plurality of data, these devices are very complex and therefore relatively expensive. In actual use the options provided by these devices are often not needed. Thus, in many cases these elaborate and relatively expensive devices are not sufficiently utilized.

A control device for another conveying system is also known from German Patent Publication DE 21 35 330 A1, wherein plate-shaped information carriers are disposed on the conveying means. Binary-coded fixed magnetic markers are attached to these information carriers on information tracks which are parallel with each other. Information, such as the conveying destination or the like, can be transmitted by means of an appropriate magnetic orientation of these markers. In this case the respective polarity of the magnetic markers can be detected by means of Hall sensors.

OBJECT AND SUMMARY OF THE INVENTION

In light of the above mentioned known transport systems, it is an object of the present invention to provide a cost-effective transport system for textile cheese-producing machines which, as a function of the respective winding state of the spinning cops being unwound, assures a dependable association of the cops with appropriate processing and preparation devices.

This object is attained in accordance with the present invention by a system for transporting spinning cops in a textile machine which utilizes a plurality of transport plates for supporting spinning cops thereon with each transport plate including an information carrier in the form of a magnet formed of ferromagnetic material having a high retentivity and capable of reversing magnetic polarity electromagnetically. At least one electrically chargeable encoding coil is arranged in the transport system for selectively applying a defined polarity to any selected magnet, and control means are provided for detecting a characteristic of the spinning cops and actuating the encoding coil as a function of the detected characteristic of each spinning cop.

The present invention has the advantage that the transport system is cost-effective and the transport plates and their information carriers are of a simple rugged construction and insensitive to a substantial degree to environmental effects, such as prevail in spinning and winding operations. By employing information carriers in the form of encodable magnets, disposed in the transport plates of the spinning cops, it is possible to achieve a control circuit for the spinning cops in the transport system of the textile machine such as could only be realized heretofore with considerably more elaborate and correspondingly more expensive means. Such coded magnets have a core made of a ferromagnetic material, which has a high retentivity whereby the coded magnets can be oriented in a defined manner in an electrical field and then dependably retain the applied polarity.

The polarity of the coded magnets in this case is selectively switchable by means of special encoding coils having a ferromagnetic base body surrounded by an electric coil which can be charged with current. A defined orientation of the exciting electrical field, and thus a defined orientation of the polarity of each coded magnet, are possible by means of the direction of flow of the current in the electric coil.

The respective polarity of the coded magnets can be simply and dependably detected by means of appropriate sensor devices. In the present invention, the sensor devices are preferably embodied as cost-effective Hall sensors. Since Hall sensors react as a function of their installed position either to a "north" or a "south" polarity of the coded magnets, it is possible to detect the respective polarity of the coded magnets in a relatively simple manner with these cost-effective components.

The transport system of a cheese-producing textile machine typically has a cop delivery track extending the length of the machine, from which several preparation tracks branch. A cop preparation station or an additional preparation station are respectively disposed at the preparation tracks. Hall sensors, which are connected with the control device of the textile machine, are positioned ahead of the respective branchings to the preparation tracks to detect the respective information carriers, i.e., the polarization of the magnets, of the transport plates. Electromagnetic switches are disposed in the entry area of the preparation tracks and are actuated via the control device as a function of the detected polarity of the respective information carriers of the transport plates to convey the transport plates with their spinning cops to the appropriate cop preparation stations.

Furthermore, the exits of the preparation tracks are connected via two branch removal tracks to a distribution track as well as back to the cop delivery track. A controllable switch installed in advance of the branching of the two removal tracks permits the transport plates to be removed in accordance with their destination as a function of the result of the cop preparation which is monitored in a simple manner by a sensor device, for example an optical sensor, disposed adjacent to the cop preparation station.

In addition to the normal cop preparation station, the transport system preferably has an additional preparation station to which those spinning cops which could not be processed in the first cop preparation station are brought. As viewed in the transport direction, an encoding coil is arranged downstream of this additional preparation station for repolarizing the information carriers of those spinning cops which could not be processed even in the additional preparation station, thereby to identify them for subsequent processing steps.

Hall sensors are also disposed in the area of transport tracks which extend transversely through the plurality of winding or other operating stations of the textile machine. These sensor devices, which are preferably installed at the unwinding positions of the individual winding stations, detect the presence of a transport plate containing a spinning cop and thereupon initiate the rewinding process at the corresponding winding station.

The transport system also includes a return track extending along the operating stations for receiving cops processed therein. A Hall sensor is associated with the return track for detecting the respective polarity of the magnets of the transport plates conveyed thereon and one encoding coil is arranged in association with the return track for operation in relation to the Hall sensor. A tube monitor is associated with the return track for detecting the presence or absence of yarn on the cops, and another encoding coil associated with the return track is arranged downstream of the tube monitor for operation in relation thereto. The return track is connected via a connecting track with the cop delivery track and a switch is arranged at an entrance to the connecting track for actuation as a function of the tube monitor. A tube cleaning track branches from the connecting track and a controllable switch at the tube cleaning track controls transferral of cops thereonto. The tube cleaning track also includes a tube cleaning device and a Hall sensor disposed upstream of the tube cleaning device.

In sum, this arrangement results in a transport system, which makes possible the rapid and well-directed supply and processing of the spinning cops to be handled in a textile cheese-producing machine.

Further details of the invention will be understood in an exemplary embodiment of the present invention described below with reference to the accompanying drawings.

DETAILED DESCRIPTION OF THE PREFERRED EMBODIMENT

Figure 1:
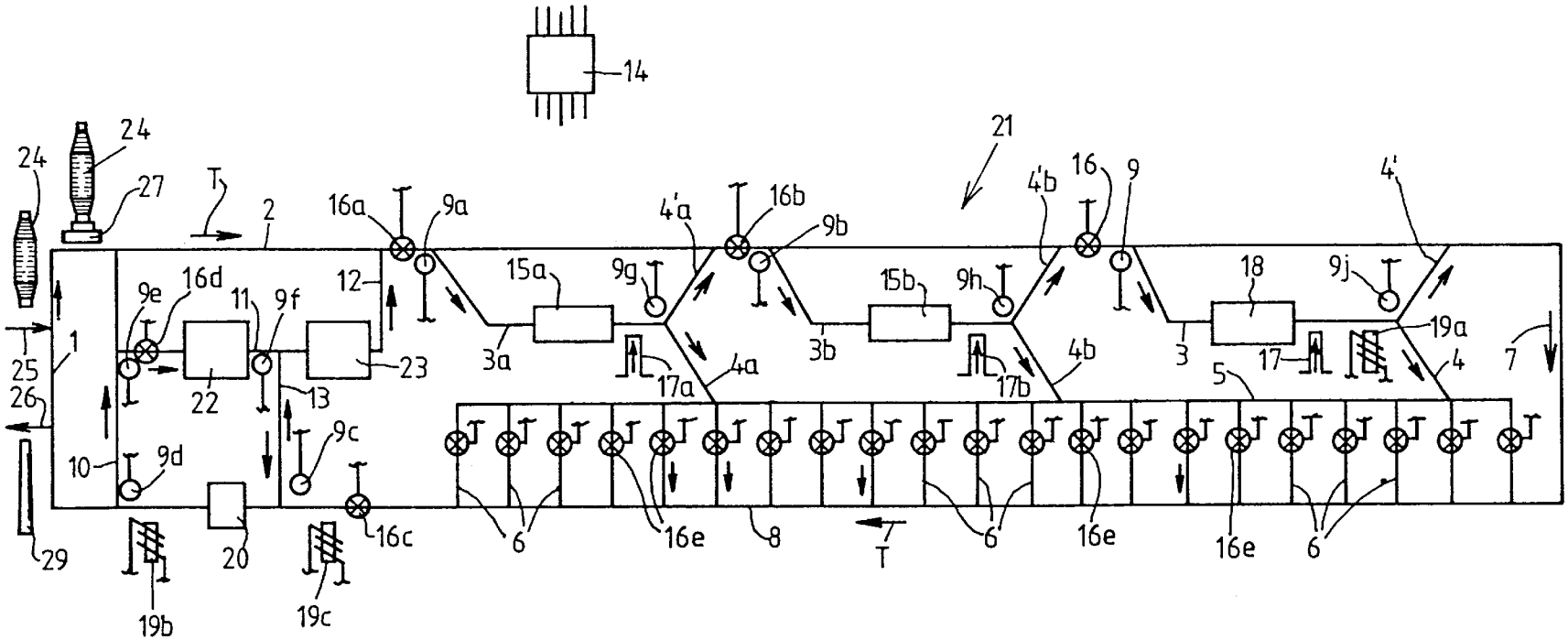
FIG. 1 is a schematic top plan view of a transport system of an automatic cheese winder in accordance with the present invention, utilizing transport plates whose information carriers are embodied as coded magnets.

Referring now to the accompanying drawings and initially to FIG. 1, a transport system according to the present invention is shown schematically at 21 in an embodiment adapted for use with a generally conventional automatic cheese winder, which therefore is not represented for sake of clarity and simplicity. Transport plates 27, which may be in the form of pallets sometimes called peg trays and which function as part of the bobbin winding machine, circulate in the transport system 21 and carry yarn wound spinning cops 24 or empty tubes 29. The transport plates 27 are equipped with information carriers or encoded magnet 32, which will be explained in more detail below.

As is known to be common, the transport system 21 has a plurality of transport tracks of different types and functions. A transfer track 1 in this case serves as the interface of the instant transport system 21 with transport systems (not represented) of textile machines which are situated in advance of the winding machine in the production process, typically ring spinning machines.

The spinning cops 24 produced in the ring spinning machines are delivered via a connecting track 25 to the transfer track 1 of the transport system 21 for the bobbin winding machine, and the empty tubes 29 which have been unwound by the winding machine are delivered via the transfer track 1 of the transport system 21 to a connecting track 26 for return to the ring spinning machines, the transfer of the cops and tubes to and from the transfer track 1 being accomplished by a repositioning device (not shown).

In the process of transferring spinning cops 24 to the transport system 21, the cops 24 are placed in upstanding disposition onto transport plates 27 associated with the bobbin winding machine and are conveyed over a cop delivery track 2 extending the length of the machine into the area of one of several cop preparation tracks 3*a*, 3*b*, 3. Cop preparation stations 15*a* or 15*b* are respectively positioned along the preparation tracks 3*a*, 3*b*, for purposes of loosening the reserve winding of the cops and preparing a tip winding of the loosened yarn in a known manner. An additional preparation station 18 for spinning cops with problems is arranged along the preparation track 3. The ends of the preparation stations 3*a*, 3*b*, 3 are branched by means of first removal tracks 4*a*, 4*b*, 4 connected respectively with a distributor track 5 serving as a cop storage track, and by means of second removal tracks 4*a*', 4*b*', 4' which connect again with the cop delivery track 2.

The distributor track 5 is periodically switched to travel alternatingly in opposite directions to deliver the spinning cops 24 to the entrance areas of the transverse transport tracks 6, which extend respectively through the individual winding stations and connect at the respective ends of the transverse transport tracks 6 with a return track 8. The return track 8 extends lengthwise along the winding machine opposite the winding stations from the cop delivery track 2 to travel in the direction T toward the transfer track 1, the return track 8 being directly connected at its upstream end with the cop delivery track 2 via a connecting track 7 and being connected at its downstream end with the transfer track 1.

The transport system 21 additionally has a branch track 10 extending from the return track 8 shortly in advance of the transfer track 1, with a tube cleaning track 11 branching from the branch track 10 and merging into a manual preparation track 12 which connects into the cop delivery track 2. A connecting track 13 extends from the manual preparation track 12 to the return track 8. A tube monitor 20 is positioned along the return track 8 immediately following the connecting track 13 and in advance of the branch track 10, for detecting the unwinding status of tubes being transported from the winding stations. A tube cleaning device 22 is disposed along the tube cleaning track 11 and a manual preparation station 23 is disposed along the manual preparation track 12.

Electromagnetic switches 9*a*, 9*b*, 9 or 9*g*, 9*h*, 9*j*, which can be triggered individually in a defined manner, are disposed in the area of the respective entrances to the preparation tracks 3*a*, 3*b*, 3 and at the branching of the removal tracks 4*a*, 4*a*', 4*b*, 4*b*', 4, 4' therefrom. Such electromagnetic switches are also located at the entry to the passage 10 (magnetic switch 9*d*), at the entry to the tube cleaning track 11 (magnetic switch 9*e*) as well as on both sides of the transport track 13 (magnet switch 9*c* and 9*f*). These electromagnetic switches are connected via appropriate control lines to a central control device 14 of the winding machine which actuates the switches according to a control program stored therein.

Sensor devices 16*a*, 16*b*, 16, preferably Hall sensors, are arranged in the area of the cop delivery track 2, respectively ahead of the entrance branches to the preparation tracks 3*a*, 3*b*, 3. Such Hall sensors are also installed along the return track 8 in advance of its connection with the transport track 13 (Hall sensor 16*c*), in the area of the tube cleaning track 11 (Hall sensor 16*d*) and in the area of each of the respective winding heads within the transverse transport tracks 6 (Hall sensors 16*e*).

The transport system 21 furthermore has sensor devices 17*a*, 17*b*, 17, which monitor the success of the cop preparation stations 15*a*, 15*b*, or the additional preparation station 18, and communicate with the control device 14 which, if necessary, initiates actuation of the respective electromagnetic switches 9*g*, 9*h*, 9*j* placed downstream in the transport direction T.

An encoding coil 19*a* is installed in the area of the additional preparation station 18. Additional encoding coils 19*b* and 19*c* are located along the return track 8, the encoding coil 19*c* being disposed ahead of the entry into the transport track 13, and the encoding coil 19*b* after the tube monitor 20.

Besides the cop preparation stations 15*a* and 15*b*, the additional preparation station 18 and.

Figure 2:
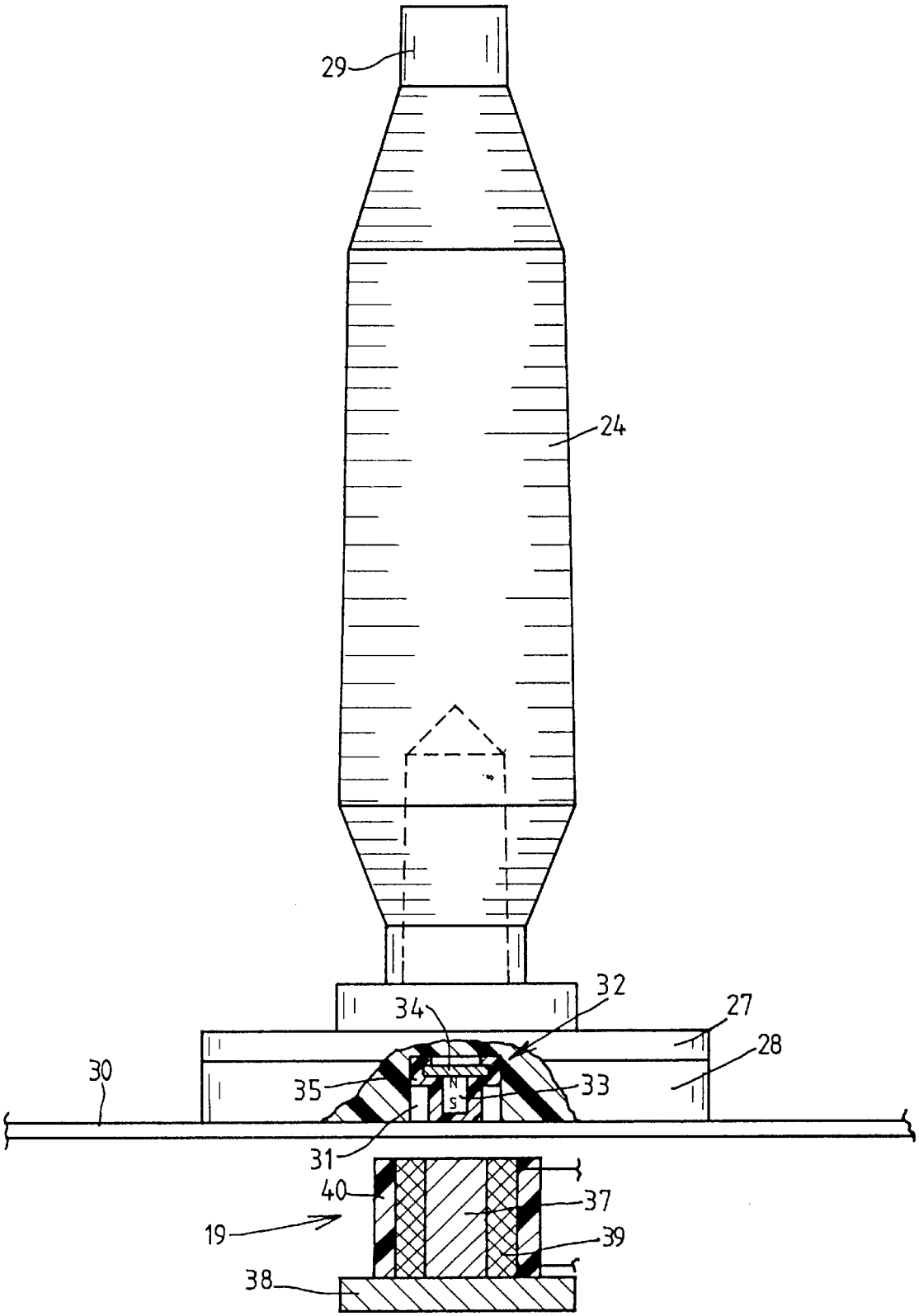
FIG. 2 is a lateral side elevational view of a transport plate with an information carrier in the form of a coded magnet in accordance with the present invention, along with a coding coil for polarizing the information carrier.

FIG. 2 shows, in an enlarged scale, a spinning cop 24, which is positioned with the base of its tube 29 on a transport plate 27. These transport plates 27 are known within the art and are customarily made of plastic with a metallic annular outer band 28 in order to make the employment of the electromagnetic switches possible. The transport plates 27 are conveyed in the transport system 21 by means of circulating endless conveyor belts or the like, as represented by the belt 30, forming the various aforementioned tracks with lateral guide devices alongside the conveyor belts being employed to guide the plates in a known manner and therefore the lateral guide devices are not represented in FIG. 2.

On their underside, the transport plates 27 have an opening 31 in which an encoded magnet 32 is seated. Essentially the encoded magnet consists of a core 33 of ferromagnetic material having a high retentivity with a sheet metal yoke 34 at one pole of the magnet 32 and a plastic sheathing 35 encasing the magnet 32 and the yoke 34.

According to the present invention, the encoding coils 19*a*, 19*b*, 19*c* are adapted for encoding the magnetic orientation of the magnets 32 and, for such purpose, are disposed below the conveyor tracks at the aforementioned locations in the transport system 21 to act on the underside of the transport plates 27, as represented by the encoding coil 19 in FIG. 2. Such encoding coils 19 as a rule have an iron core 37, a yoke 38 at one end of the core 37 and a winding 39 which can be supplied with current and encloses the iron core. In the embodiment illustrated, the winding 39 is preferably protected by a plastic sheathing 40.

The functioning of the transport system 21 in accordance with the present invention may thus be understood. In the area of the transfer track 1, the spinning cops 24, which are delivered from a ring spinning machine via the connecting track 25, are placed by a repositioner device (not shown) onto the transport plates 27 of the bobbin winding machine, whose coded magnets 32 respectively have the magnetic direction "south".

Subsequently the transport plates 27 along with the spinning cops 24 supported thereon are conveyed from the transfer track 1 to the cop delivery track 2, and in the process reach the area of a Hall sensor 16*a* disposed ahead of the branch to the preparation track 3*a*. The Hall sensor 16*a* is installed in an appropriate position to recognize that the delivered transport plate 27 has the magnetic direction "south" and, via the control device 14, causes the electromagnetic switch 9*a* to be supplied with current. Because of its metallic ring 28, the transport plate 27 is thereby diverted onto the preparation track 3*a*, so that the spinning cop 24 can be prepared in the cop preparation station 15*a*, i.e., the reserve winding is loosened from the spinning cop and a tip winding, which can be handled at a winding station of the machine, is applied.

The immediately following sensor device 17*a* detects successfully prepared spinning cops which are conveyed via the removal track 4*a* to the distributor track 5 and are distributed thereby to the individual transverse transport tracks 6 and thus to the winding stations, where the presence of a successfully prepared spinning cop 24 is detected by Hall sensors 16*e* arranged, for example, in the area of the unwinding position of the winding stations.

Unwound tubes 29 are taken from the winding stations via the transverse transport tracks 6 and placed on the return track 8 and conveyed back to the transfer track 1. In the process, the unwound tubes 29 first pass a Hall sensor 16*c*, which checks the magnetic direction of the coded magnets 32 of the respective transport plates 27.

Transport plates whose coded magnets have the magnetic direction "south", as in the above described case, are delivered without further treatment to the tube monitor 20, which checks the tube 29 for possible yarn winding remnants. If the tube monitor 20 detects that a respective tube 29 still has a useful remaining amount of yarn which could be unwound, the magnetic switch 9*d* in the entry area of the branch track 10 is actuated and the respective transport plate 27 is diverted onto the branch track 10 to the cop delivery track 2, where the cop is again processed in one of the cop preparation stations 15*a* or 15*b*, or in the additional preparation station 18, and is subsequently again guided to a winding station.

Tubes 29 which are detected by the tube monitor 20 to have insufficient remaining yarn to be useful are delivered to the coding coil 19*b* disposed downstream of the tube monitor 20, which serves to repolarize the coded magnet 32 of the respective transport plate 27 to the magnetic direction "north". In addition, the magnetic switch 9*d* at the entrance of the branch track 10 as well as the magnetic switch 9*e* at the entrance of the tube cleaning track 11 are actuated so that the tube 29 is conducted to the tube cleaning device 22.

To prevent full spinning cops or residual cops with a considerable remainder of yarn winding from accidentally reaching the tube cleaning device 22, which would result in considerable difficulties thereat, a Hall sensor 16*d* is disposed ahead of the tube cleaning device 22 and checks the coding status of each respective transport plate 27 and triggers an alarm in case any plate 27 having the magnetic direction "south" is detected, which identifies a mistake.

Tubes which have been successfully processed in the tube cleaning device 22, are directed via the electromagnetic switch 9*f* onto the transport track 13 and conveyed back to the return track 8 and the winding state of these tubes 29 is subsequently again checked by the tube monitor 20. When the tube monitor 20 determines that the tube 29 has been cleaned, the coded magnet 32 of the respective transport plate 27 is polarized back to the magnetic direction "south" by the coding coil 19*b* arranged downstream of the tube monitor 20, and the transport plate 20 with the cleaned tube is conveyed to the transfer track 1, where the tube 29 is removed to the spinning machine via the connecting track 26.

Cops 24 which could not be successfully processed in the first preparation station 15*a* are detected by the sensor device 17*a* and are directed by the appropriate actuation of the electromagnetic switch 9*g* onto the removal track 4' to return to the cop delivery track 2 for another preparation attempt in a downstream preparation station 15*b*. If the subsequent preparation attempt in the second preparation station 15*b* is also unsuccessful, the spinning cop 24 is conveyed to an additional preparation station 18.

Cops, which are successfully processed in the additional preparation station 18 are conducted via its associated removal track 4 to the distributing track 5 and thus to the respective winding stations, as described above in connection with the preparation stations 15*a*, 15*b*.

With cops which could also not be prepared in the additional preparation station 18, which is detected by means of a sensor device 17, the encoded magnet 32 of the respective transport plate 27 is repolarized to the magnetic direction "north" by the coding coil 19*a*, and the electromagnetic switch 9*j* is actuated to immediately return the transport plate via the removal track 4' to the connecting track 7 and therefrom to the return track 8. The Hall sensor 16*c* disposed in the area of the return track 8 detects that the delivered transport plate 27 does not have a "south" polarity, Thereupon, the Hall sensor 16*c* actuates the coding coil 19*c* to reset the polarity of the respective transport plate 27 back to the magnetic direction "south" and also actuates the electromagnetic switch 9*c* to divert the respective transport plate 27 onto the transport track 13 to be conveyed to the manual preparation station 23. Thus, the respective transport plate 27 again has the "normal" south polarity when the cop 23 leaves the manual preparation station 23 and therefore is ready to be directed along the cop preparation track 3*a* to the distributor track 5.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A system for transporting spinning cops in a textile machine, comprising a plurality of transport plates for supporting spinning cops thereon, each transport plate including a magnet formed of ferromagnetic material having a high retentivity and capable of reversing magnetic polarity electromagnetically, at least one electrically chargeable encoding coil arranged in the transport system for selectively applying a defined polarity to any selected magnet, and control means for detecting a characteristic of the spinning cops and actuating the encoding coil as a function of the detected characteristic of each spinning cop.

2. The transport system in accordance with claim 1, wherein the control means comprises sensors arranged in the transport system for detecting the respective polarity of the magnets.

3. The transport system in accordance with claim 2, wherein the sensors comprise Hall sensors.

4. The transport system in accordance with claim 2, and wherein the control means further comprises switches disposed downstream of the sensors for controlling downstream transport of the transport plates as a function of the detected polarity.

5. The transport system in accordance with claim 1, further comprising a cop delivery track, at least one cop preparation track having an entrance branching from the cop delivery track, a controllable switch disposed at the entrance to the cop preparation track, a sensor disposed along the cop delivery track upstream of the switch, and a control device operatively connected with the sensor and the switch for actuating the switch in relation to the sensor.

6. The transport system in accordance with claim 5, and further comprising a cop distributor track for distributing prepared cops among a plurality of operating stations of the textile machine, and wherein the cop preparation track has an exit connected with the cop delivery track via a first removal branch and connected with the distributor track via a second removal branch, and a controllable switch disposed in the area of the exit from the cop preparation track for selectively controlling delivery of cops between the first and second removal tracks.

7. The transport system in accordance with claim 6, and further comprising a cop preparation station along the cop preparation track and a sensor for monitoring the result of the cop preparation station, the sensor being operatively connected with the control means and the control means being operatively connected with the switch at the exit of the cop preparation track for controlling operation of the switch in relation to the sensed result of the cop preparation station.

8. The transport system in accordance with claim 5, further comprising a second cop preparation track branching from the cop delivery track and a cop preparation station associated with the second cop preparation track, one encoding coil being associated with the cop preparation station of the second cop preparation track for repolarizing the magnets of transport plates whose supported cops are not successively prepared by the preparation station.

9. The transport system in accordance with claim 1, wherein the textile machine includes a plurality of operating stations and the transport system includes a corresponding plurality of transport tracks respectively associated with the operating stations for delivering cops thereto, and the control means comprises a Hall sensor respectively associated with each of the plurality of transport tracks for the operating stations for detecting the respective polarity of the magnets of the transport plates.

10. The transport system in accordance with claim 9, further comprising a return track extending along the operating stations for received cops processed therein, a Hall sensor associated with the return track for detecting the respective polarity of the magnets of the transport plates conveyed thereon and one encoding coil arranged in association with the return track for operation in relation to the Hall sensor.

11. The transport system in accordance with claim 9, and further comprising a return track extending along the operating stations for receiving cops processed therein, a tube monitor associated with the return track for detecting the presence or absence of yarn on the cops, and an encoding coil associated with the return track being arranged downstream of the tube monitor for operation in relation thereto.

12. The transport system in accordance with claim 11, wherein the return track is connected via a connecting track with the cop delivery track and a switch is arranged at an entrance to the connecting track for actuation as a function of the tube monitor.

13. The transport system in accordance with claim 12, wherein a tube cleaning track branches from the connecting track and a controllable switch at the tube cleaning track controls transferral of cops thereonto.

14. The transport system in accordance with claim 13, wherein the tube cleaning track includes a tube cleaning device and a Hall sensor disposed upstream of the tube cleaning device.

* * * * *